US009482990B2

(12) United States Patent
Watanabe

(10) Patent No.: US 9,482,990 B2
(45) Date of Patent: Nov. 1, 2016

(54) SHUTTER MECHANISM FOR CONTROLLING DEVELOPER SUPPLIED FROM A DEVELOPER SUPPLYING DEVICE

(71) Applicant: CANON KABUSHIKI KAISHA, Tokyo (JP)

(72) Inventor: Koichi Watanabe, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/638,919

(22) Filed: Mar. 4, 2015

(65) Prior Publication Data

US 2015/0253692 A1 Sep. 10, 2015

(30) Foreign Application Priority Data

Mar. 7, 2014 (JP) ..... 2014-045415

(51) Int. Cl.
*G03G 15/08* (2006.01)

(52) U.S. Cl.
CPC ..... *G03G 15/0886* (2013.01)

(58) Field of Classification Search
CPC ..... G03G 15/0886
USPC ..... 399/260, 262
See application file for complete search history.

(56) References Cited

U.S. PATENT DOCUMENTS

2014/0064794 A1* 3/2014 Takahashi ..... G03G 15/0886 399/262

FOREIGN PATENT DOCUMENTS

| | | | |
|---|---|---|---|
| JP | 2009069231 | A | 4/2009 |
| JP | 2009210966 | A | 9/2009 |
| JP | 2010055035 | A | 3/2010 |
| JP | 2012008457 | A | 1/2012 |
| JP | 201218457 | A | 6/2012 |

* cited by examiner

*Primary Examiner* — Quana M Grainger
(74) *Attorney, Agent, or Firm* — Canon U.S.A. Inc., IP Division

(57) ABSTRACT

A developing device includes a shutter moving portion and a receiving-port shutter that are combined together, with a recessed portion and a projecting portion thereof being in engagement with each other, so that a developer receiving port is opened or shut. A gap is provided between the recessed portion and the projecting portion, and the shutter moving portion is swingable with respect to the receiving-port shutter. Even if the shutter moving portion vibrates by following the displacement of a toner conveying portion, the vibration is not transmitted to the receiving-port shutter because the shutter moving portion absorbs the vibration, preventing the receiving-port shutter from flapping. Thus, the leakage of developer that may occur particularly in a case of package shipment of the developing device and an image forming apparatus is suppressed.

5 Claims, 6 Drawing Sheets

SHUTTER MECHANISM FOR CONTROLLING DEVELOPER SUPPLIED FROM A DEVELOPER SUPPLYING DEVICE

BACKGROUND OF THE INVENTION

1. Field of the Invention

The present invention relates to a developing device that is attachable to and detachable from a developer supplying device provided in a body of an image forming apparatus. Specifically, the present invention relates to a shutter mechanism that opens and shuts a developer receiving port that receives developer supplied from the developer supplying device.

2. Description of the Related Art

There are known image forming apparatuses including developing devices and developer supplying devices. The developing devices each develop an electrostatic image formed on a photoconductive drum into a toner image with, for example, a two-component developer composed of a toner and a magnetic carrier. The developer supplying devices each supply the developer to the developing device. The developing device is provided either as a sole component or as a unit called process cartridge including other associated image forming elements (such as a photoconductor drum), and is detachably attached to the body of the image forming apparatus. The process cartridge (the developing device) is connected to the developer supplying device provided in the body of the image forming apparatus. In the body of the image forming apparatus, a developer receiving port provided in the process cartridge communicates with a developer supply port provided in the developer supplying device.

Such an image forming apparatus includes a shutter mechanism that opens and shuts the developer supply port in conjunction with the attaching or detaching of the process cartridge so that the developer does not leak from the developer supply port of the developer supplying device when the process cartridge is attached to or detached from the body of the image forming apparatus (see Japanese Patent Laid-Open No. 2012-108457).

Another known process cartridge includes a shutter mechanism that opens and shuts a developer receiving port of a developing device (see Japanese Patent Laid-Open No. 2012-8457). In this shutter mechanism, when the image forming apparatus is powered for the first time, a shutter that has been at a position for shutting the developer receiving port is slid to a position for opening the developer receiving port in accordance with the rotation of a stirring member provided in a developer container.

Process cartridges (developing devices), which are consumables, are each shipped while being set in the body of an image forming apparatus. In the case of the shutter mechanism disclosed by Japanese Patent Laid-Open No. 2012-108457, a gap tends to be produced at the connection between the developer supply port and the developer receiving port because of vibrations, impacts, or the like that may be applied to the process cartridge during transportation, installation, or the like. In such a case, the developer may leak from the gap.

In the case of the shutter mechanism disclosed by Japanese Patent Laid-Open No. 2012-8457, the above leakage of the developer from the connection between the developer supply port and the developer receiving port is not likely to occur. However, this shutter mechanism requires a large torque out of the necessity of not only stirring and conveying the developer but also moving the shutter, and therefore requires a high-performance motor. Moreover, the shutter mechanism has a complicated configuration with an increased number of components. Because of this, a process cartridge including a shutter mechanism as described, has high costs despite being a consumable.

SUMMARY OF THE INVENTION

The present invention provides a developing device including a shutter mechanism having a simple configuration for suppressing the leakage of developer that may occur particularly when the developing device is packed and shipped in a state of being set in an image forming apparatus.

According to an aspect of the present invention, there is provided a developing device that is attachable to and detachable from a body of an image forming apparatus including a developer supplying device. The developing device includes a developer receiving port that receives developer supplied from the developer supplying device, a shutter that opens and shuts the developer receiving port, and a shutter moving portion that comes into contact with the developer supplying device with the insertion of the developing device into the body of the image forming apparatus. The shutter is slidable in a direction of insertion of the developing device into the body of the image forming apparatus and is movable between a position for opening the developer receiving port and a position for shutting the developer receiving port. When the shutter moving portion comes into contact with the developer supplying device, the shutter moving portion moves the shutter from the position for shutting the developer receiving port to the position for opening the developer receiving port. The shutter moving portion is in engagement with the shutter in such a manner as to be swingable.

Further features of the present invention will become apparent from the following description of exemplary embodiments with reference to the attached drawings.

DESCRIPTION OF THE EMBODIMENTS

A developing device according to an embodiment of the present invention will now be described with reference to FIGS. 1 to 8. First, an outline of an image forming apparatus including the developing device, as a process cartridge, according to the embodiment of the present invention will be described with reference to FIG. 1.

Image Forming Apparatus

Figure 1:
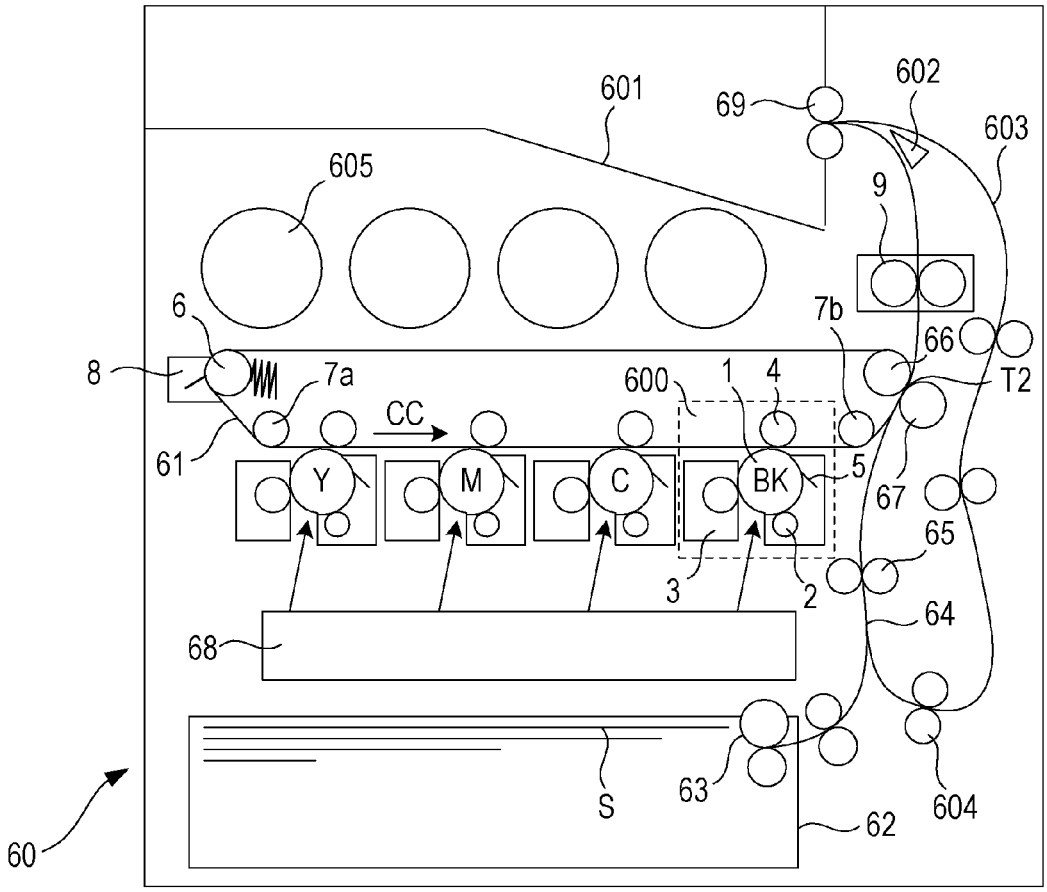
FIG. 1 is a schematic diagram of an image forming apparatus.

FIG. 1 is a sectional view of a color image forming apparatus 60 employing an electrophotographic method. The image forming apparatus 60 is of an intermediate-transfer tandem type in which image forming units (process cartridges) 600 for four respective colors are provided in such a manner as to face an intermediate transfer belt 61. The intermediate-transfer tandem type is regarded as a recent-year mainstream because of its high productivity and compatibility to the conveyance of various kinds of media.

In the image forming apparatus 60, a recording medium S is conveyed as follows. Recording media S are stacked in a recording medium storage (cassette) 62. The recording media S are each fed from the recording medium storage 62 by a pair of feed rollers 63 in accordance with the timing of image formation and by, for example, a friction-separation method. The recording medium S thus fed by the pair of feed rollers 63 is conveyed to a pair of registration rollers 65 provided at a position in a conveyance path 64. The pair of registration rollers 65 corrects the skew of the recording medium S and adjusts the timing of conveyance of the recording medium S. Then, the recording medium S is conveyed to a secondary transfer site T2. The secondary transfer site T2 corresponds to a transfer nip provided between a secondary-transfer inner roller 66 and a secondary-transfer outer roller 67 that face each other. At the secondary transfer site T2, a predetermined pressure and a predetermined electrostatic load bias are applied to toner images formed on the recording medium S, whereby the toner images are fixed to the recording medium S.

In accordance with the timing of the above conveyance of the recording medium S to the secondary transfer site T2, images are formed and conveyed to the secondary transfer site T2 as described below, following the description of the image forming units 600. The image forming units 600 for the respective colors basically have the same configuration except the colors of toners. Therefore, the image forming unit 600 for black (BK) will be described as a representative.

The image forming unit 600 (a process cartridge) basically includes a photoconductive drum (photoconductor or image bearing member) 1, a charging device 2, a developing device 3, a photoconductive-drum cleaner 5, and so forth. The surface of the photoconductive drum 1, which rotates when driven, is uniformly charged in advance by the charging device 2. Then, an electrostatic latent image is formed by an exposure device 68 that is driven in accordance with a signal corresponding to image information. The electrostatic latent image thus formed on the photoconductive drum 1 is developed and visualized with a toner by the developing device 3. The toner image thus formed on the photoconductive drum 1 is subjected to a predetermined pressure and a predetermined electrostatic load bias that are applied by a primary transfer device 4 provided across the intermediate transfer belt 61 from the image forming unit 600, whereby the toner image on the photoconductive drum 1 is transferred for the primary transfer to the intermediate transfer belt 61. A small amount of residual toner remaining on the photoconductive drum 1 after the transfer is collected by the photoconductive-drum cleaner 5 and is to be reused in the subsequent image formation. While the image forming apparatus 60 illustrated in FIG. 1 includes four image forming units 600 for yellow (Y), magenta (M), cyan (C), and black (BK), the number of image forming units 600 provided for respectively different colors is not limited to four, and the order of arrangement of the image forming units 600 is not limited to that illustrated in FIG. 1, either. The developer used in the developing device 3 is a two-component developer as a mixture of a toner and a magnetic carrier. The toner is supplied to the developing device 3 from a toner bottle 605, which is set in the image forming apparatus 60, via a toner supplying device (not illustrated).

Now, the intermediate transfer belt 61 will be described. The intermediate transfer belt 61 is an endless belt that is stretched around a tension roller 6, the secondary-transfer inner roller 66, and follower rollers 7*a* and 7*b*. The intermediate transfer belt 61 rotates, when driven, in a direction indicated by arrow CC illustrated in FIG. 1. The secondary-transfer inner roller 66 also functions as a driving roller that drives the intermediate transfer belt 61. The image forming units 600 for Y, M, C, and BK perform the above-described image forming process for the four respective colors in parallel with one another, and toner images are transferred for the primary transfer to the intermediate transfer belt 61 in such a manner as to be sequentially superposed one on top of another from the one formed by the most upstream image forming unit 600. Ultimately, a full-color toner image is obtained on the intermediate transfer belt 61. The full-color toner image is then conveyed to the secondary transfer site T2. Residual toner that has passed through the secondary transfer site T2 is collected by a transfer-belt cleaner 8.

The recording-medium-conveying process and the image forming process described above are performed synchronously with each other, whereby the recording medium S and the full-color toner image meet at the secondary transfer site T2, where the secondary transfer is performed. Subsequently, the recording medium S is conveyed to a fixing device 9, where the toner image is melted and is fixed to the recording medium S with a predetermined pressure and a predetermined heating energy applied thereto. The recording medium S now having the fixed image is discharged onto a discharge tray 601 by a pair of discharge rollers 69 that rotate in the forward direction, or is further conveyed for duplex image formation.

If duplex image formation is required, after the recording medium S is conveyed with the forward rotation of the pair of discharge rollers 69 until the trailing end of the recording medium S passes a switching member 602, the pair of discharge rollers 69 undergo backward rotation, whereby the leading end and the trailing end of the recording medium S are switched, and the recording medium S is conveyed into a duplex conveyance path 603. Then, synchronously with the subsequent job, the recording medium S is conveyed into the conveyance path 64 again by a pair of refeed rollers 604. The conveying process and the image forming process on the other side of the recording medium S performed thereafter are the same as those described above, and description thereof is omitted.

Process Cartridge

Figure 2A:
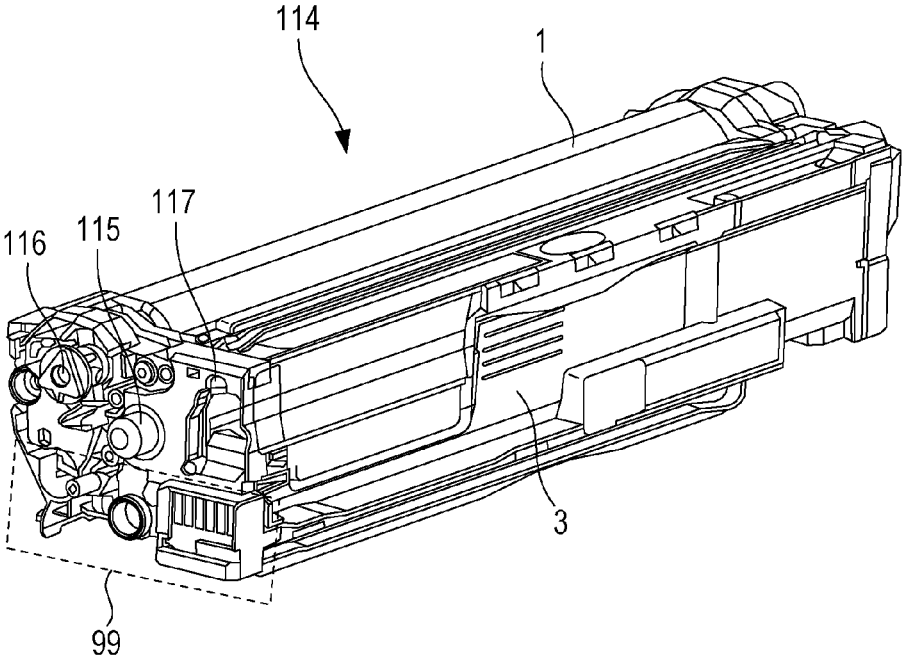
FIGS. 2A and 2B are perspective views of a process cartridge according to an embodiment of the present invention.
Figure 2B:
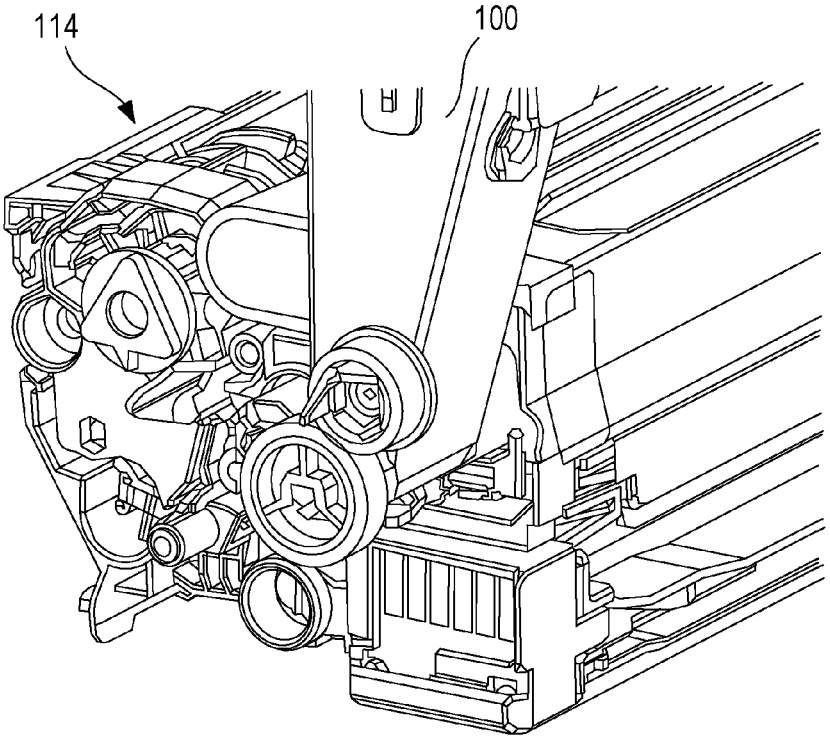

The process cartridge (hereinafter denoted by 114) according to the embodiment of the present invention will now be described. FIG. 2A is a perspective view of the process cartridge 114. FIG. 2B is an enlarged view illustrating a part of the process cartridge 114 that has been attached to the image forming apparatus 60. The process cartridge 114 is a unit including the developing device 3 and other associated image forming elements. In FIG. 2A, as a matter of convenience, the associated image forming elements except the photoconductive drum 1 are not illustrated.

The process cartridge 114 is detachably attached to the image forming apparatus 60 (see FIG. 1) by being slid into the image forming apparatus 60 in the longitudinal direction thereof (in the direction of insertion). As illustrated in FIG. 2A, the process cartridge 114 has a conveying-portion-insertion slot 117 as an insertion portion in a side face thereof (on the near side in FIG. 2A) to be connected to the image forming apparatus 60. To attach the process cartridge 114 to the image forming apparatus 60, a toner conveying portion 106 of a toner supplying device 100 (see FIG. 3 to be referred to below) is inserted into the conveying-portion-insertion slot 117, and the process cartridge 114 is slid along the toner conveying portion 106, thereby being inserted into the body of the image forming apparatus 60. The process cartridge 114 is pushed into the body of the image forming apparatus 60 until the process cartridge 114 reaches the position illustrated in FIG. 2B, thereby being connected to the toner supplying device 100. In the state illustrated in FIG. 2B, a developer receiving port 126 provided in the process cartridge 114 and a developer supply port 111 provided in the toner supplying device 100 communicate with each other (see FIG. 3). In this state, the developer is supplied from the toner supplying device 100 into the developing device 3 via the developer supply port 111 and the developer receiving port 126.

The process cartridge 114 further has, on the side face thereof to be connected to the image forming apparatus 60, a developing-device-drive-inputting portion 115, a photoconductive-drum-drive-inputting portion 116, a contact portion 99, and so forth that are provided for respective purposes of, for example, the transmission of driving forces and the supply of electric power from the image forming apparatus 60 to the process cartridge 114. That is, the process cartridge 114 does not operate alone but operates when attached to the image forming apparatus 60 and thus receiving the driving forces, the electric power, and so forth from the body of the image forming apparatus 60.

Toner Supplying Device

The toner supplying device 100 to be connected to the process cartridge 114 will now be described with reference to FIG. 3. The toner supplying device 100 as a developer supplying device is fixed to the body of the image forming apparatus 60. Specifically, the toner supplying device 100 has two positioning bosses 104 provided at upper and lower positions, respectively, thereof. The positioning bosses 104 are fitted into respective holes provided in a rear plate 103 that is fixed to the body of the image forming apparatus 60, whereby the toner supplying device 100 is positioned. The toner supplying device 100 thus positioned is fastened to the rear plate 103 with a screw 105. A body-side driving unit (not illustrated) is provided on the rear side (the left side in FIG. 3) of the toner supplying device 100, that is, across the toner supplying device 100 from the positioning bosses 104. The body-side driving unit is connected to a stirring member 110.

A toner-bottle-holding member (not illustrated) that is attached to the rear plate 103 is provided above the toner supplying device 100. The toner supplying device 100 and the tonner-bottle-holding member are connected to each other but are both sealed with a sealing member (not illustrated) interposed therebetween. The toner bottle 605 (see FIG. 1) is connectable to the toner-bottle-holding member.

The toner supplying device 100 includes the toner conveying portion 106 having a shape that is fittable into the conveying-portion-insertion slot 117 provided in the process cartridge 114. As illustrated in FIG. 3, the toner conveying portion 106 as a conveying portion projects toward the process cartridge 114. The toner conveying portion 106 includes the stirring member 110 that stirs and conveys the toner. The stirring member 110 is rotatably provided in the toner conveying portion 106. The toner conveying portion 106 has the developer supply port 111 on the downstream side in the direction of toner conveyance. The toner is discharged from the developer supply port 111 to the outside of the toner conveying portion 106.

The conveyance of the toner in the toner supplying device 100 will now be described. The toner is supplied from the toner bottle 605 (see FIG. 1) in such a manner as to drop from the top of the toner supplying device 100 toward the toner conveying portion 106 with the gravitational force, and accumulates on the upstream side of the stirring member 110 in the direction of toner conveyance in the toner conveying portion 106. When the body-side driving unit (not illustrated) provided for the toner supplying device 100 receives a toner supply signal from the image forming apparatus 60, the body-side driving unit drives the stirring member 110 to rotate. The stirring member 110 has a screw structure in which a stirring blade made of a nonmagnetic material is spirally provided around a rotating shaft. Hence, when the stirring member 110 rotates, the toner accumulated on the upstream side in the direction of toner conveyance is stirred and conveyed toward the process cartridge 114 in the toner conveying portion 106. The toner thus conveyed in the toner conveying portion 106 by the stirring member 110 is discharged from the developer supply port 111 to the outside of the toner conveying portion 106.

In the toner supplying device 100 configured as described above, if the developer supply port 111 is left open when the process cartridge 114 is attached to or detached from the image forming apparatus 60, the toner may leak from the developer supply port 111. Therefore, the toner supplying device 100 is provided with a supply-port-shutting mechanism that opens and shuts the developer supply port 111. The supply-port-shutting mechanism includes a shutter pushing member 124, a supply-port shutter 125, and a spring (not illustrated). The supply-port shutter 125 is connected to the shutter pushing member 124 and is attached to the toner conveying portion 106 in such a manner as to be slidable between a position for shutting the developer supply port 111 and a position for opening the developer supply port 111 in conjunction with the insertion and removal of the process cartridge 114 into and from the image forming apparatus 60. The shutter pushing member 124 operates in conjunction with the insertion and removal of the process cartridge 114 into and from the image forming apparatus 60. Specifically, the shutter pushing member 124 is constantly urged by the spring exerting a moving force acting in a direction in which the developer supply port 111 is shut. When the process cartridge 114 is inserted into the image forming apparatus 60, the supply-port shutter 125 is moved to the position for opening the developer supply port 111 against the urging force of the spring. When the process cartridge 114 is removed from the image forming apparatus 60, the supply-port shutter 125 is made to follow the movement of the process cartridge 114 by the spring and is moved to the position for shutting the developer supply port 111. Thus, the supply-port shutter 125 opens the developer supply port 111 with the attaching of the process cartridge 114 to the body of the image forming apparatus 60, and shuts the developer supply port 111 with the removal of the process cartridge 114 from the body of the image forming apparatus 60.

It is the recent-year mainstream that image forming apparatuses are shipped with process cartridges being set therein (hereinafter such a shipment method is referred to as package shipment) so that the users can perform the initial installation work as easily as possible and can immediately output images by simply turning on the apparatuses. Considering such circumstances, it is necessary to prevent the developer from leaking from the connection between the developer supply port 111 of the toner supplying device 100 and the developer receiving port 126 of the process cartridge 114 (see FIG. 3) during the transportation of the image forming apparatus 60.

Figure 8:
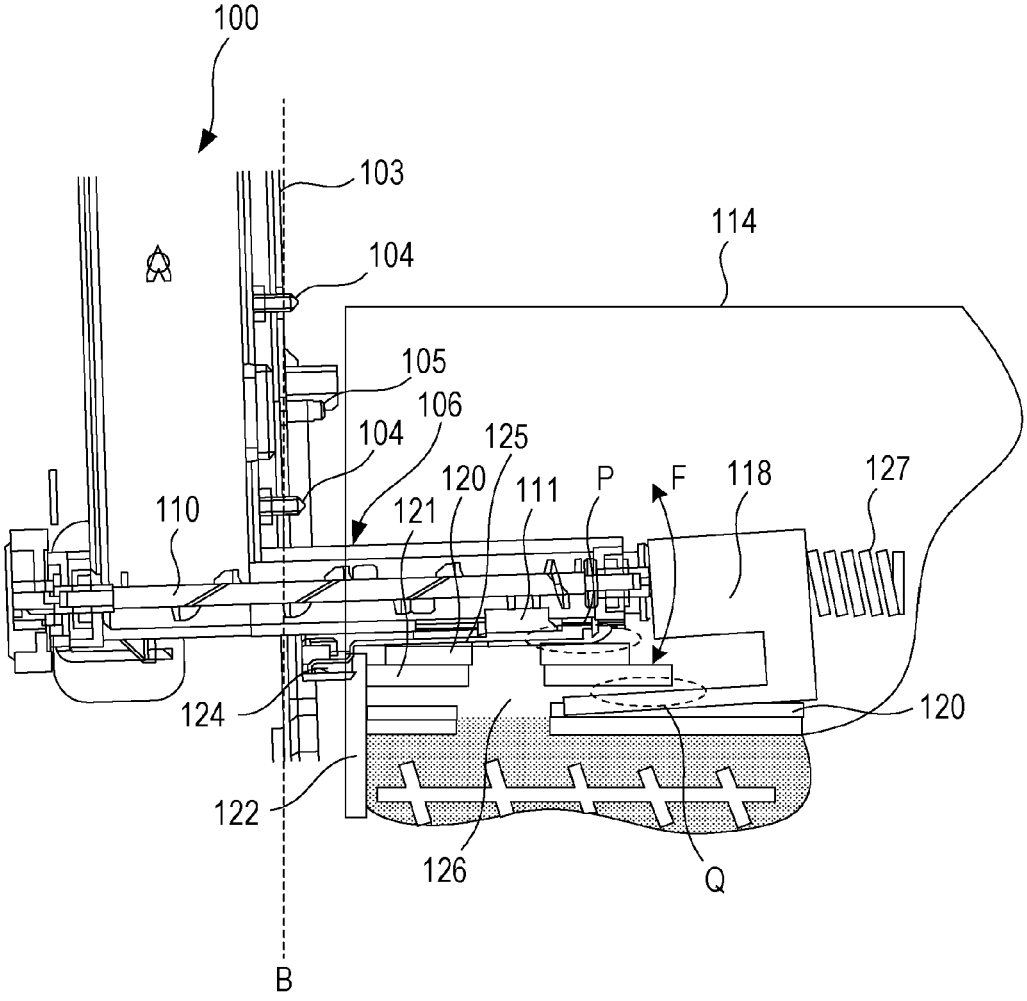
FIG. 8 is a sectional view of a comparative process cartridge that is taken in the longitudinal direction of the process cartridge.

The reasons why the developer leaks from the connection in the case of package shipment will now be described in comparison with a known example illustrated in FIG. 8. In the package shipment, an image forming apparatus is packed in a cardboard box with cushioning materials provided in gaps between the image forming apparatus and the bottom surface, side surfaces, and top surfaces of the cardboard box. The image forming apparatus thus packed is transported by any of various means, for example, by air, by sail, or by land. Considering such conditions for transportation, a transportation test was conducted in which the image forming apparatus was vibrated within an expected range of frequencies. The result of the transportation test shows the following. When the image forming apparatus was vibrated, some components of the image forming apparatus were displaced, giving some backlash to a shutter member 118 and producing gaps between the shutter member 118 and peripheral components. Consequently, the developer leaked from the gaps.

More specifically, for example, if the image forming apparatus is vibrated in the direction in which the shutter member 118 is movable (the horizontal direction in FIG. 8), the toner bottle 605 (see FIG. 1) and the toner-bottle-holding member (not illustrated) are also vibrated in the same direction, thereby vibrating peripheral components significantly. Since the toner-bottle-holding member is fixed to the rear plate 103, the vibration of the toner-bottle-holding member is transmitted to the toner supplying device 100 via the rear plate 103. The toner-bottle-holding member is also directly connected to the toner supplying device 100. Therefore, when the toner-bottle-holding member vibrates, the toner supplying device 100 that is fixed to the rear plate 103 with substantially a single screw 105 is displaced, i.e., rotates, about a position near the position where the toner supplying device 100 is fastened with the screw 105. Particularly, the toner conveying portion 106 of the toner supplying device 100 vibrates significantly in a direction indicated by arrow F illustrated in FIG. 8. Actually, the toner conveying portion 106 vibrates three-dimensionally, including the direction indicated by arrow F and the direction of movement of the shutter member 118. That is, the toner conveying portion 106 is displaced in such a manner as to vibrate along a conical locus.

In the state where the process cartridge 114 is set in the image forming apparatus, the tip of the toner conveying portion 106 is in contact with the shutter member 118 that is urged by a spring 127. Therefore, when the toner conveying portion 106 vibrates along a conical locus as described above, the shutter member 118 follows the movement of the toner conveying portion 106 and is displaced. A sealing member 120 that seals the developer in is provided below the shutter member 118. The sealing member 120 is made of a flexible material. Therefore, as illustrated in FIG. 8, the shutter member 118 may be tilted every time the toner conveying portion 106 is displaced. (Note that dotted line B illustrated in FIG. 8 is a vertical line, and the toner supplying device 100 is tilted with respect to line B.) That is, the vibration makes the shutter member 118 flap. If the shutter member 118 flaps, a gap is produced (in an enclosed area Q in FIG. 8) between the shutter member 118 and a shutter holding member 121 that holds the shutter member 118 by pressing down a portion of the shutter member 118, and the developer may leak from the gap. Furthermore, the toner conveying portion 106 is displaced relative to the process cartridge 114 in a direction intersecting the direction of movement of the shutter member 118. Therefore, another gap tends to be produced (in an enclosed area P in FIG. 8) between the toner conveying portion 106 and the sealing member 120 provided above the shutter holding member 121 and being in contact with the toner conveying portion 106, and the developer may leak from the gap.

In view of the above reasons, to prevent the leakage of the developer from the connection between the developer supply port 111 and the developer receiving port 126, the displacement of the toner supplying device 100 (specifically, the toner conveying portion 106) that is caused by the vibration of the image forming apparatus as a whole only needs to be prevented from being transmitted to the shutter member 118. Furthermore, the process cartridge 114 as a whole only needs to be made to follow the movement of the toner conveying portion 106 that is displaced with the vibration of the image forming apparatus as a whole. Hence, in the process cartridge 114 according to the embodiment of the present invention, the above two features are embodied. The two features will now be described.

The first feature is as follows. As illustrated in FIG. 3, the process cartridge 114 includes a receiving-port-shutting mechanism that includes two separate members, which are a shutter moving portion 119A and a receiving-port shutter 119B. The receiving-port-shutting mechanism corresponds to the known shutter member 118 (see FIG. 8), which includes only one component. The receiving-port-shutting mechanism as a shutter device includes the shutter moving portion 119A, the receiving-port shutter 119B, and the spring 127 as an elastic member. The receiving-port shutter 119B is attached to a developer container 122 in such a manner as to be slidable between a position for shutting the developer receiving port 126 and a position for opening the developer receiving port 126. The sealing member 120, made of a flexible material, is provided between the receiving-port shutter 119B and the developer container 122 so as to seal the developer in. The receiving-port shutter 119B includes a projecting portion 119D extending toward the shutter moving portion 119A. The shutter moving portion 119A has a recessed portion 119C that receives the projecting portion 119D. As to be described below, the receiving-port shutter 119B and the shutter moving portion 119A are combined with each other, with the projecting portion 119D and the recessed portion 119C being in engagement with each other. The combination of the receiving-port shutter 119B and the shutter moving portion 119A functions as a single shutter member. A predetermined size of a gap (also referred to as play) is provided between the recessed portion 119C and the projecting portion 119D. The gap allows the shutter moving portion 119A to swing with respect to the receiving-port shutter 119B.

The shutter moving portion 119A is provided on the rear side in the conveying-portion-insertion slot 117 (see FIG. 2A) and is constantly urged by the spring 127 with a moving force acting in a direction in which the shutter moving portion 119A shuts the developer receiving port 126. When the process cartridge 114 is inserted into the body of the image forming apparatus 60, the shutter moving portion 119A comes into contact with the toner conveying portion 106 and is moved. Specifically, as the process cartridge 114 is inserted into the body of the image forming apparatus 60, the shutter moving portion 119A moves the receiving-port shutter 119B, against the urging force of the spring 127, to the position for opening the developer receiving port 126. On the other hand, as the process cartridge 114 is removed from the body of the image forming apparatus 60, the spring 127 moves the receiving-port shutter 119B via the shutter moving portion 119A to the position for shutting the developer receiving port 126.

Figure 3:
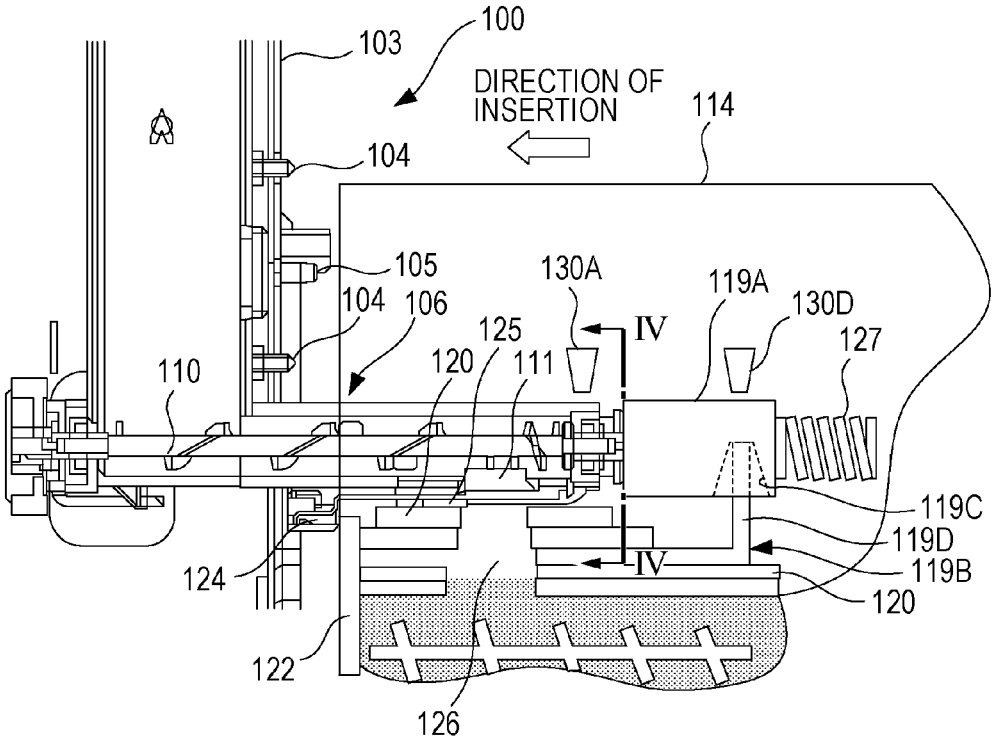
FIG. 3 is a sectional view of the process cartridge according to the embodiment of the present invention that is taken in the longitudinal direction of the process cartridge.

As illustrated in FIG. 3, the process cartridge 114 has a rib 130D as a first restricting portion provided above the shutter moving portion 119A. The rib 130D restricts the displacement of the shutter moving portion 119A in the upward direction in FIG. 3 (a direction intersecting the direction of movement of the receiving-port shutter 119B). Hence, the vibration of the shutter moving portion 119A is suppressed, and the receiving-port shutter 119B is prevented from coming off the shutter moving portion 119A. In the embodiment, the distance between the rib 130D and the shutter moving portion 119A (the allowable length of movement) illustrated in FIG. 3 is set to a smaller value than the length of engagement between the recessed portion 119C and the projecting portion 119D (the length by which the projecting portion 119D is inserted into the recessed portion 119C in the vertical direction in FIG. 3).

Figure 4:
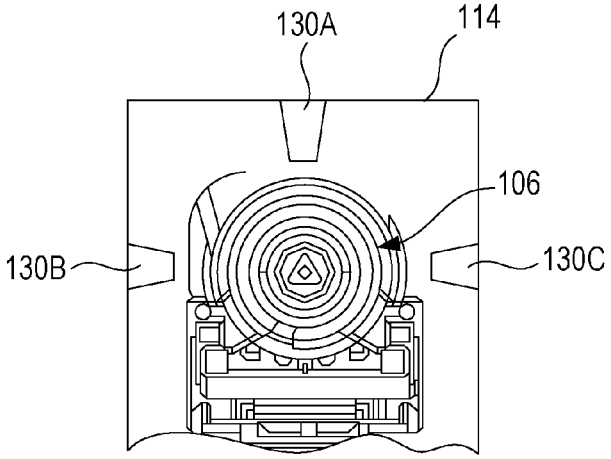
FIG. 4 is a sectional view of the process cartridge according to the embodiment of the present invention that is taken along line IV-IV illustrated in FIG. 3, the line IV-IV extending vertically to the longitudinal direction of the process cartridge.

The second feature is as follows. As illustrated in FIG. 4, the process cartridge 114 has ribs 130A to 130C as second restricting portions or restricting portions. The ribs 130A to 130C are provided in the conveying-portion-insertion slot 117 (in the insertion portion, see FIG. 2) and are arranged in such a manner as to surround the toner conveying portion 106 inserted into the process cartridge 114. If the toner conveying portion 106 is displaced along a conical locus with the vibration of the image forming apparatus 60 as a whole, any of the ribs 130A to 130C come into contact with the toner conveying portion 106. In the embodiment, even if the toner conveying portion 106 is displaced along a conical locus, the developer does not leak from the connection between the developer supply port 111 of the toner supplying device 100 and the developer receiving port 126 of the process cartridge 114 (see FIG. 3). Specifically, the relative movements of the toner conveying portion 106 and the process cartridge 114 are restricted by the ribs 130A to 130C such that an area defined by vertically projecting the developer supply port 111 is positioned within an area defined as the developer receiving port 126.

With the presence of the ribs 130A to 130C, the process cartridge 114 follows the movement of the toner conveying portion 106 such that the developer supply port 111 is positioned within the area defined by the developer receiving port 126 in the vertical direction as described above. For example, if the toner conveying portion 106 is displaced upward in FIG. 4 because of any vibration, the toner conveying portion 106 comes into contact with the rib 130A, whereby the process cartridge 114 is also displaced upward. If the toner conveying portion 106 is displaced in the horizontal direction in FIG. 4, the toner conveying portion 106 comes into contact with either the rib 130B or the rib 130C, whereby the process cartridge 114 is also displaced in the horizontal direction. Thus, making the entirety of the process cartridge 114 follow the movement of the toner conveying portion 106 maintains the relative position of the toner supplying device 100 (specifically, the toner conveying portion 106) with respect to the positions of the shutter moving portion 119A and the receiving-port shutter 119B. That is, the ribs 130A to 130C restrict the relative displacement of the toner supplying device 100 in a direction intersecting the direction of movement of the receiving-port shutter 119B such that the toner supplying device 100 is not displaced relative to the shutter moving portion 119A and the receiving-port shutter 119B.

As described above, the shutter moving portion 119A and the receiving-port shutter 119B are combined with each other by making the recessed portion 119C and the projecting portion 119D engage with each other, whereby the shutter moving portion 119A is swingable with respect to the receiving-port shutter 119B. To embody such a configuration, in the state where the recessed portion 119C and the projecting portion 119D are in engagement with each other and the tip of the projecting portion 119D and the bottom surface of the recessed portion 119C are in contact with each other, gaps (play) need to be provided between the sidewalls of the recessed portion 119C and the side surfaces of the projecting portion 119D. To provide such a gap, the sidewalls of the recessed portion 119C are each inclined at a predetermined angle with respect to a corresponding one of the side surfaces of the projecting portion 119D that faces the sidewall. The angle of inclination is determined in association with the amount of displacement of the toner conveying portion 106 or the amount of displacement of the shutter moving portion 119A. If the toner conveying portion 106 is displaced along a conical locus, the shutter moving portion 119A vibrates by following the displacement of the toner conveying portion 106. In the embodiment, this vibration is not transmitted to the receiving-port shutter 119B because the shutter moving portion 119A absorbs the vibration. Therefore, the receiving-port shutter 119B is not displaced with respect to the developer receiving port 126. As to be described below, the angle of displacement of the toner conveying portion 106 with respect to the process cartridge 114 is set to a value smaller than or equal to the angle of swing of the shutter moving portion 119A with respect to the receiving-port shutter 119B. Specifically, the ribs 130A to 130C restrict the angle of displacement of the toner conveying portion 106 and determine the angle of swing between the recessed portion 119C and the projecting portion 119D. This configuration will be described in more detail with reference to FIGS. 5 and 6.

Figure 5:
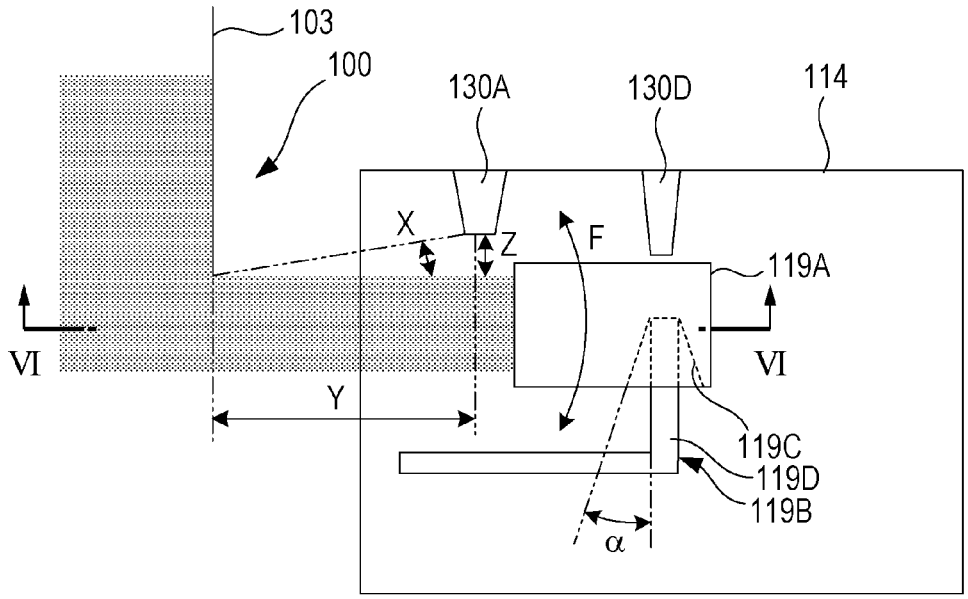
FIG. 5 is a schematic side view illustrating a receiving-port-shutting mechanism.
Figure 6:
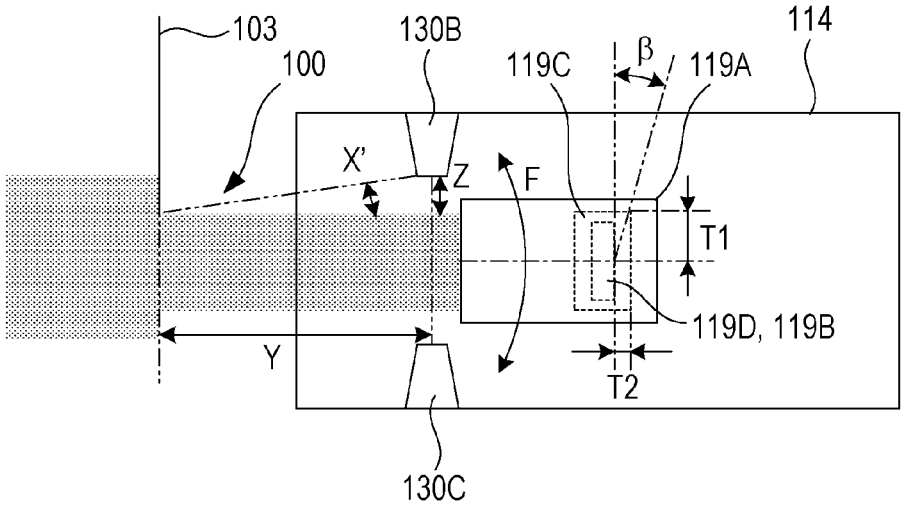
FIG. 6 is a schematic top view illustrating the receiving-port-shutting mechanism.

The above configuration of the process cartridge 114 will further be described with reference to FIG. 5 from the viewpoint of the amount of displacement of the toner conveying portion 106 in the vertical direction. Let the gap between the toner conveying portion 106 and the rib 130A be Z, and the length from the base of the toner conveying portion 106 (the position of the rear plate 103 to which the toner supplying device 100 is fixed) to the rib 130A be Y. Then, an angle of displacement X of the toner conveying portion 106 in the vertical direction is expressed as follows.

$$X=\tan^{-1}(Z/Y) \qquad \text{Expression 1}$$

To prevent the receiving-port shutter 119B from following the displacement of the toner conveying portion 106 while allowing the shutter moving portion 119A to follow the displacement of the toner conveying portion 106, the angle of inclination $\alpha$ of the inclined sidewall of the recessed portion 119C is set to a value larger than or equal to the angle of displacement X. For example, if the gap Z is 0.5 mm and the length Y is 150 mm, the angle of inclination $\alpha$ is set to a value larger than 0.19°. Such a relationship is established between the angle of inclination $\alpha$ and the amount of displacement of the toner conveying portion 106 in the vertical direction. A state where the gap Z between the toner conveying portion 106 and the rib 130A is zero, that is, a state where the tip of the rib 130A is to be in contact with the outer surface of the toner conveying portion 106, is not allowed in terms of tolerance because the process cartridge 114 may interfere with the toner conveying portion 106 when being inserted into the body of the image forming apparatus 60. The above description of the amount of displacement of the toner conveying portion 106 in the vertical direction also applies to the amount of displacement of the shutter moving portion 119A in the vertical direction, description of which is therefore omitted herein.

The toner conveying portion 106 also vibrates in the horizontal direction. The configuration of the process cartridge 114 will now be described with reference to FIG. 6 from the viewpoint of the amount of displacement of the toner conveying portion 106 in the horizontal direction. An angle of displacement X' of the toner conveying portion 106 in the horizontal direction is also expressed by Expression 1 give above. Note that, however, the symbol Z in Expression 1 now denotes the gap between the toner conveying portion 106 and the rib 130B (or the rib 130C). An angle of inclination β between the shutter moving portion 119A and the receiving-port shutter 119B is obtained from Expression 2 given below. In Expression 2, T1 denotes the length from the center line of the projecting portion 119D in the long-side direction of the projecting portion 119D to a sidewall of the recessed portion 119C, and T2 denotes the gap between a surface of the projecting portion 119D and a sidewall of the recessed portion 119C that face each other in the short-side direction of the projecting portion 119D.

$$\beta=\tan^{-1}(T1/T2) \qquad \text{Expression 2}$$

To prevent the receiving-port shutter 119B from following the displacement of the toner conveying portion 106 while allowing the shutter moving portion 119A to follow the displacement of the toner conveying portion 106, T1 and T2 in Expression 1 are set to respective values that establish a relationship of $X<\beta$. Thus, the shape of the recessed portion 119C of the shutter moving portion 119A and the shape of the projecting portion 119D of the receiving-port shutter 119B are determined.

Figure 7A:
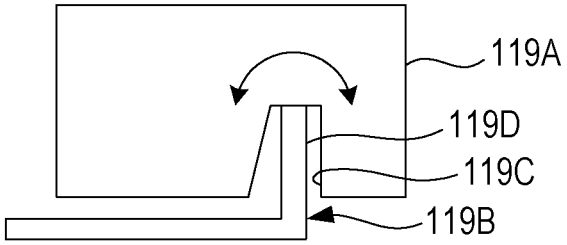
FIGS. 7A to 7C are sectional views illustrating exemplary shapes of a recessed portion and a projecting portion.
Figure 7B:
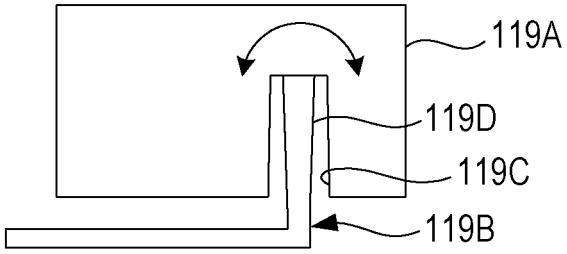
Figure 7C:
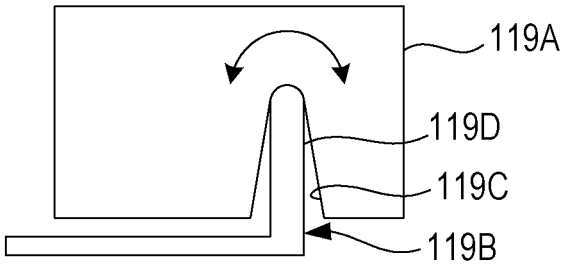

Hence, the shapes of the recessed portion 119C and the projecting portion 119D are not limited to those illustrated in FIG. 3 and may be, for example, any of those illustrated in FIGS. 7A to 7C. FIGS. 7A to 7C are sectional views illustrating exemplary shapes of the recessed portion 119C and the projecting portion 119D. As illustrated in FIG. 7A, only one of the two sidewalls of the recessed portion 119C may be inclined. As illustrated in FIG. 7B, instead of giving an inclination to any of the sidewalls of the recessed portion 119C, the projecting portion 119D may have inclined surfaces in such a manner as to be widened toward the tip thereof. That is, either the recessed portion 119C or the projecting portion 119D only needs to have at least one inclined surface. As illustrated in FIG. 7C, at least one of the tip of the projecting portion 119D and the bottom surface of the recessed portion 119C may be smoothly curved. Such a configuration makes it easier for the shutter moving portion 119A to swing with respect to the receiving-port shutter 119B.

The operation of the above receiving-port-shutting mechanism will now be described with reference to FIG. 3. In the state where the process cartridge 114 is yet to be attached to the body of the image forming apparatus 60, the shutter moving portion 119A is positioned at the mouth of the conveying-portion-insertion slot 117 (see FIG. 2), thereby closing the conveying-portion-insertion slot 117. When the process cartridge 114 is pushed into the body of the image forming apparatus 60 such that the toner conveying portion 106 is inserted into the conveying-portion-insertion slot 117, the tip of the toner conveying portion 106 comes into contact with the shutter moving portion 119A. When the process cartridge 114 is further pushed into the body of the image forming apparatus 60, the shutter moving portion 119A that is urged by the spring 127 moves the receiving-port shutter 119B to the position for opening the developer receiving port 126.

Meanwhile, on the side of the toner supplying device 100, when the process cartridge 114 is further pushed into the body of the image forming apparatus 60 after the tip of the toner conveying portion 106 comes into contact with the shutter moving portion 119A, the developer container 122 of the process cartridge 114 comes into contact with the shutter pushing member 124. Such a time difference is provided on an assumption that the toner drops from the developer supply port 111 when the supply-port shutter 125 is opened. Therefore, the developer receiving port 126 of the process cartridge 114 is opened in advance so that the toner assuredly drops into the developer container 122. That is, in the embodiment, after the developer receiving port 126 is fully opened, the developer supply port 111 is opened.

When the process cartridge 114 is further pushed into the body of the image forming apparatus 60, the shutter pushing member 124 slides in the direction of insertion of the process cartridge 114 and moves the supply-port shutter 125 to the position for opening the developer supply port 111. Thus, the supply-port shutter 125 of the toner supplying device 100 and the receiving-port shutter 119B of the process cartridge 114 reach the respective opening positions, allowing the developer supply port 111 and the developer receiving port 126 to communicate with each other.

As described above, the two members, i.e., the shutter moving portion 119A and the receiving-port shutter 119B are combined together by allowing the recessed portion 119C and the projecting portion 119D thereof to engage with each other. With such a configuration, the developer receiving port 126 of the process cartridge 114 is opened or shut. A predetermined gap is provided between the recessed portion 119C and the projecting portion 119D, and the shutter moving portion 119A is swingable with respect to the receiving-port shutter 119B by the size of the gap. In such a configuration, even if the shutter moving portion 119A is vibrated by following the displacement of the toner conveying portion 106, the vibration is not transmitted to the receiving-port shutter 119B because the shutter moving portion 119A absorbs the vibration. Therefore, the receiving-port shutter 119B remains still with respect to the developer receiving port 126, that is, the receiving-port shutter 119B does not flap. In such a situation, no gap is produced at the connection between the developer supply port 111 and the developer receiving port 126. Accordingly, the developer does not leak from the connection.

The process cartridge 114 has the ribs 130A to 130C that restrict the displacement of the toner supplying device 100 (specifically, the toner conveying portion 106) and the rib 130D that restricts the displacement of the shutter moving portion 119A. The ribs 130A to 130C make the shutter moving portion 119A and the receiving-port shutter 119B follow the vibration of the toner supplying device 100, whereas the rib 130D suppresses the vibration of the shutter moving portion 119A with respect to the receiving-port shutter 119B. Thus, the receiving-port shutter 119B becomes less flappy, and the leakage of the developer from the connection is more assuredly prevented.

Furthermore, the simple configuration of the shutter mechanism in which the shutter moving portion 119A and the receiving-port shutter 119B are in engagement with each other lowers the manufacturing cost of the process cartridge 114.

While the above embodiment concerns a case where the receiving-port shutter 119B has a substantially L shape, the receiving-port shutter 119B does not necessarily have such a shape and may have any other suitable shape such as a substantially T shape. While the above embodiment concerns a case where the receiving-port shutter 119B has the projecting portion 119D and the shutter moving portion 119A has the recessed portion 119C, the shutter moving portion 119A may have the projecting portion 119D and the receiving-port shutter 119B may have the recessed portion 119C.

According to the above embodiment of the present invention, a developing device including a shutter mechanism having a simple configuration for suppressing the leakage of developer that may occur particularly in the case of package shipment is provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-045415, filed Mar. 7, 2014, which is hereby incorporated by reference herein in its entirety.

What is claimed is:

1. A developing device that is attachable to and detachable from a body of an image forming apparatus including a developer supplying device, the developing device comprising:

a developer receiving port configured to receive developer supplied from the developer supplying device; and a shutter mechanism configured to open and shut the developer receiving port according to a mounting action of the developing device, wherein the shutter mechanism comprising:

a shutter configured to open and shut the developer receiving port; and an engaging member configured to be movably provided together with the shutter and configured to movably engaged with the shutter, wherein the engaging member is configured to contact with the developer supplying member according to a mounting action of the developing device, and according to a movement of the developing device toward a mounting position of the developing device in a state where the engaging member contacting with the developer supplying member, the shutter opens the developer receiving port, and wherein the engaging member is configured to swing with respect to the shutter.

2. The developing device according to claim 1, wherein a projecting portion is arranged to either one of the engaging member and the shutter; and wherein a recessed portion is arranged to the other one of the either one of the engaged member and the shutter, so as to be engaged with the projecting portion, wherein a tip of the projecting portion is in contact with a bottom surface of the recessed portion, and wherein a gap is produced between the recessed portion and the projecting portion so that the engaging member to be swingable with respect to the shutter using the tip of the projecting portion as a fulcrum.

3. The developing device according to claim 1, wherein the gap between the projecting portion and the recessed portion becomes smaller toward the tip of the projecting portion when the projecting portion and the recessed portion are in engagement with each other.

4. The developing device according to claim 1, wherein either one of the tip of the projecting portion and the bottom surface of the recessed portion is formed in a curved shape.

5. The developing device according to claim 1, further comprising:

a restricting portion configured to restrict a relative position of the developer supplying device and the developing device when the relative position between the developer supplying device and the developing device is displaced in a state where the developing device is mounted, wherein the angle of swing of the developer supplying device with respect to the developing device is set to a value smaller than or equal to the angle of swing of the engaging member with respect to the developing device.

* * * * *